US007331441B2

(12) United States Patent
Persson

(10) Patent No.: US 7,331,441 B2
(45) Date of Patent: Feb. 19, 2008

(54) APPARATUS FOR PUSHING PACKAGING CONTAINERS

(75) Inventor: Richard Persson, Landskrona (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 41 days.

(21) Appl. No.: 10/583,318

(22) PCT Filed: Nov. 24, 2004

(86) PCT No.: PCT/SE2004/001720

§ 371 (c)(1),
(2), (4) Date: Jun. 15, 2006

(87) PCT Pub. No.: WO2005/058702

PCT Pub. Date: Jun. 30, 2005

(65) Prior Publication Data

US 2007/0108017 A1 May 17, 2007

(30) Foreign Application Priority Data

Dec. 16, 2003 (SE) ..... 0303424

(51) Int. Cl.
*B65G 47/10* (2006.01)

(52) U.S. Cl. ..... 198/370.08; 198/597; 53/234

(58) Field of Classification Search ..... 198/370.02, 198/370.08, 457.06, 469.1, 474.1, 476.1, 198/477.1, 597, 598; 53/176, 228, 234
See application file for complete search history.

(56) References Cited

U.S. PATENT DOCUMENTS

| | | | | |
|---|---|---|---|---|
| 5,052,544 | A * | 10/1991 | Anderson | 198/457.06 |
| 5,579,895 | A * | 12/1996 | Davis et al. | 198/598 |
| 5,590,513 | A * | 1/1997 | Belvederi | 53/234 |
| 5,996,310 | A | 12/1999 | Bailey et al. | |
| 6,129,350 | A | 10/2000 | St. Ours | |
| 6,186,313 | B1 * | 2/2001 | Spatafora et al. | 198/474.1 |
| 6,390,276 | B1 | 5/2002 | Haug et al. | |
| 6,612,094 | B1 * | 9/2003 | Bailey et al. | 53/234 |

FOREIGN PATENT DOCUMENTS

| | | |
|---|---|---|
| EP | 1 062 160 B1 | 12/2000 |
| SE | 456 569 B | 10/1988 |

* cited by examiner

*Primary Examiner*—James R. Bidwell
(74) *Attorney, Agent, or Firm*—Buchanan, Ingersoll & Rooney PC

(57) ABSTRACT

The disclosure relates to an apparatus (10) for pushing a number of packaging containers (12) which are supported in cassettes (18) in motion in a first direction in a packaging machine. The apparatus (10) comprises carriers (40) by means of which the packaging containers may be pushed from a first position to a second position in relation to said cassettes (18). According to the invention, the apparatus (10) comprises at least one belt (30, 32) which, in a first portion of the apparatus (10) moves in a second direction and in the second portion of the apparatus (10) moves in a third direction, and, between the first and the second portions, there is disposed a bending roller (24), and the second and third directions each make an angle (α) with the first direction, and finally the carrier (40) is connected to a shaft (38) which is secured to the belt (30, 32) by means of a clamping device.

9 Claims, 6 Drawing Sheets

Figure 1:
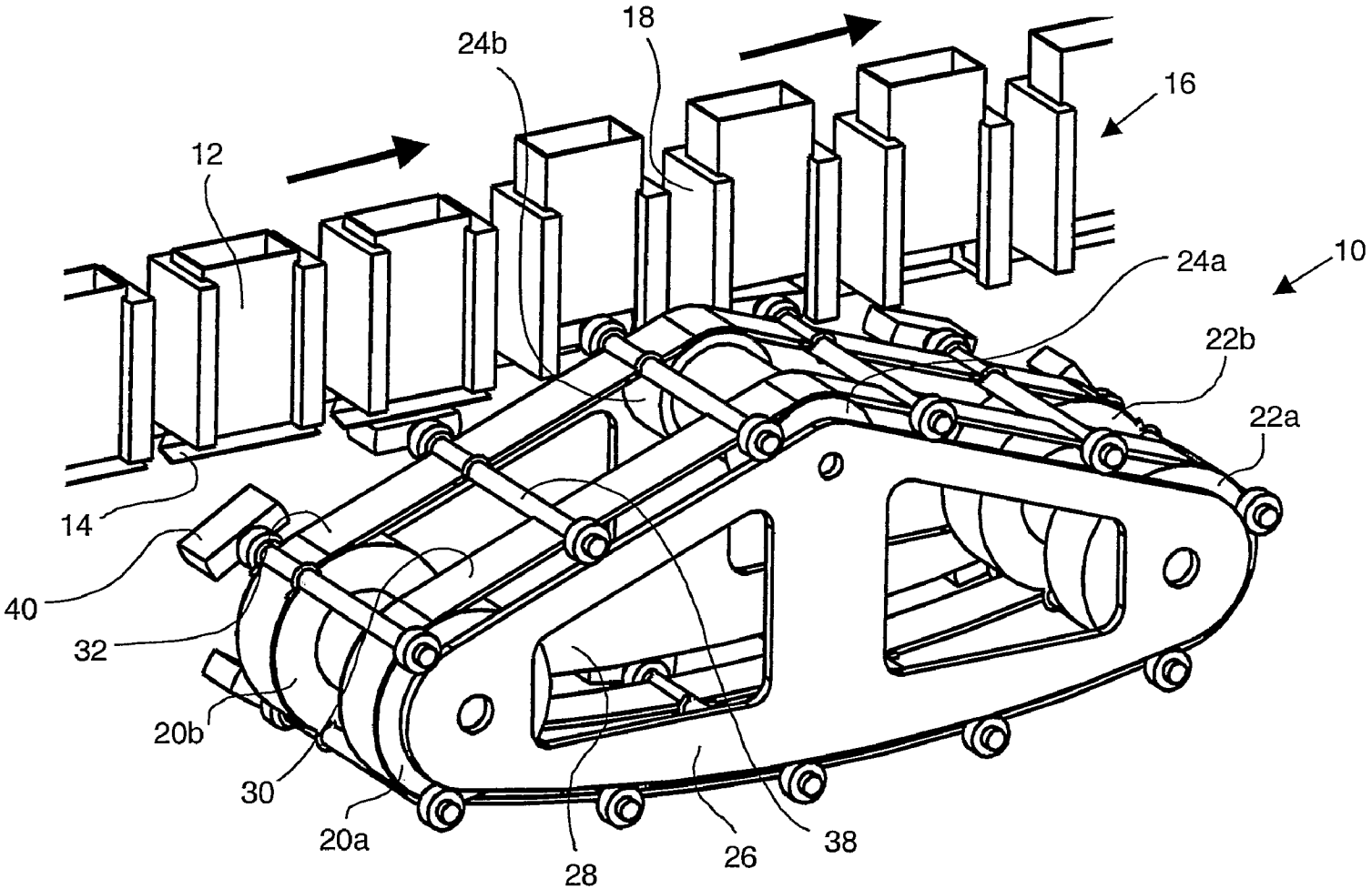

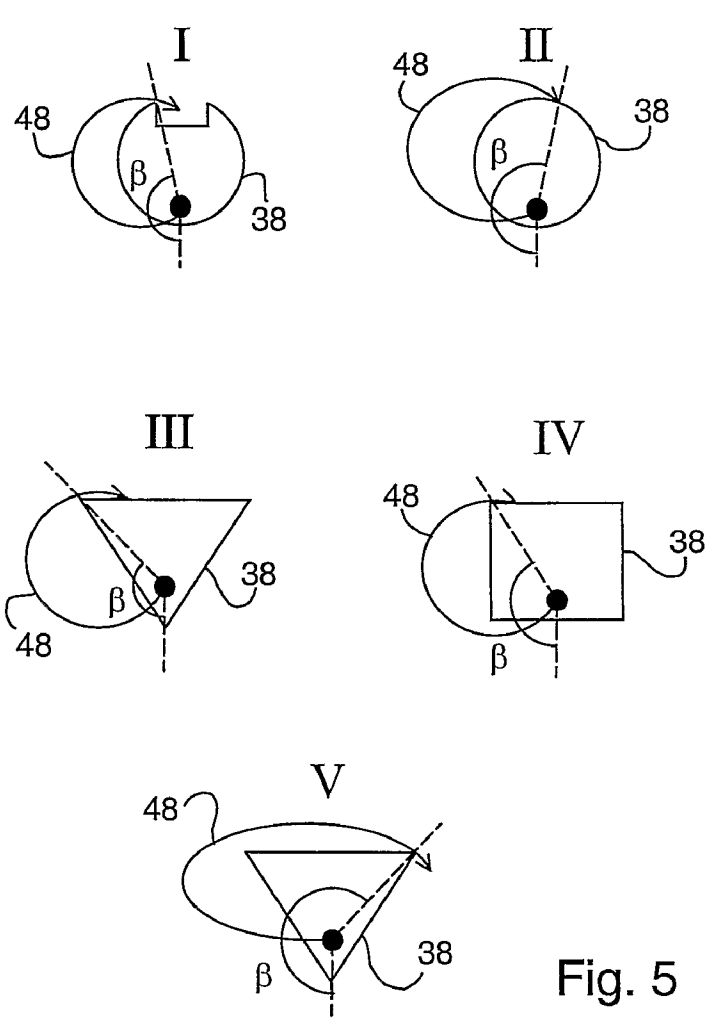
Fig. 5
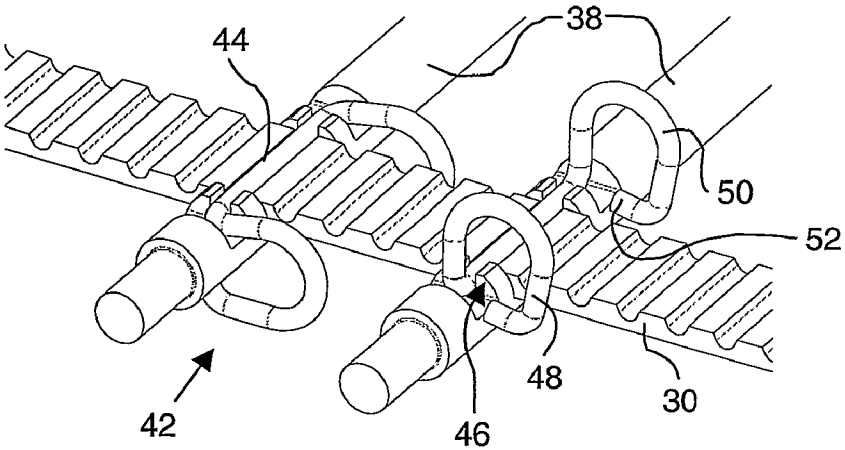
Fig. 3
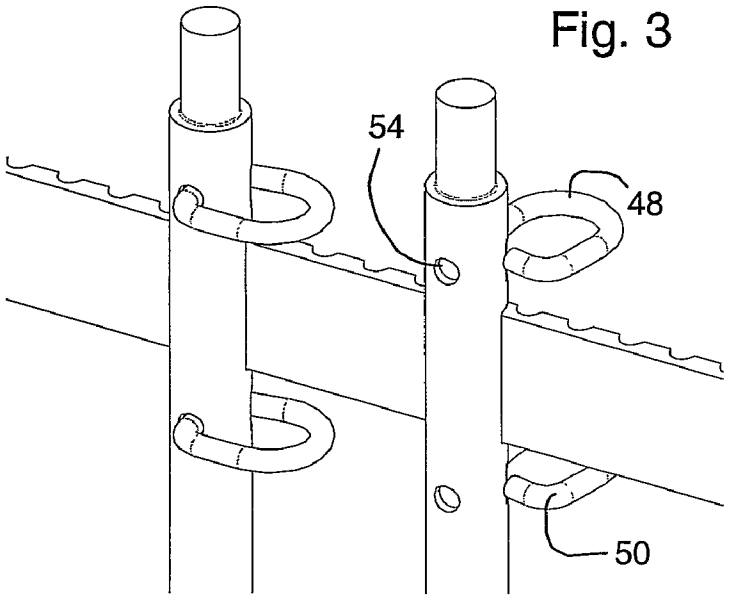

APPARATUS FOR PUSHING PACKAGING CONTAINERS

TECHNICAL FIELD

The present invention relates to an apparatus comprising a pushing mechanism which changes the position of packaging containers carried in cassettes in motion in a packaging machine.

BACKGROUND ART

Packaging containers for food products, e.g. packaging containers with liquid foods, such as, for example, juice, milk etc., or foods of a more solid nature such as, for example, soups, vegetables etc., are often manufactured from a packaging laminate which is cut to, folded and thermosealed to a finished packaging container, for example of parallelepipedic configuration. The packaging laminate comprises a carrier layer of fibrous material, such as paper or paperboard which is coated on either side with layers of thermoplastic material, such as, for example, polyethylene. The packaging laminate often also comprises a barrier layer of metal such as, for example, aluminium.

A plurality of different packaging machines for the production of these or similar types of packaging containers is known in the art. A number of these operate with tubular packaging container blanks which are fed into the machine in the flat-laid state and are raised therein so that they obtain a preferably square or rectangular cross section. During their displacement through the packaging machine, the packaging containers are progressively provided with a liquid-tight bottom, which is normally formed by compressing and sealing a first end of the packaging container blank. The packaging container is thereafter moved further to a filling station in which the desired type of contents is fed into the packaging container, whereafter the still as yet open end of the container is sealed by, for example, compressing and sealing.

Each individual packaging container which is moved through a packaging machine of this type is preferably supported by some form of conveyor which ensures that the packaging containers are moved between different stations for, for example, bottom forming, filling and top forming. In packaging machines which operate at high speeds and with rapid accelerations, it is of crucial importance that the individual packaging containers are both placed and retained in the correct position for the different operational phases, for example bottom forming and filling and, as a result, it is now usual that each individual packaging container is supported by a carrier or cassette which abuts on three sides against the packaging container and fixes it in a carefully predetermined position in relation to the conveyor and the different stations. In addition to the accurate positioning of each individual packaging container in the longitudinal and transverse directions of the conveyor, it is, in particular in mechanical processing, for example bottom or top sealing of the packaging container, also of major importance that the vertical position of the packaging container is accurately defined when it is located in the conveyor. A cassette possessing these properties is described, for example, in EP 1062160. This cassette displays an open design which makes it possible to move the packaging container into or out of the cassette at both ends thereof and it can position the packaging container in the vertical position in that one or more of the flexible, projecting parts or corner flaps of the packaging container are utilised for fixing the packaging container in the correct position. The positioning of the packaging container in the vertical direction in the cassette normally takes place using an apparatus for pushing the packaging container, the apparatus comprising a carrier plate which pushes the packaging container in, for example, an upward direction in the cassette.

SUMMARY OF THE INVENTION

One of the objects of the present invention is to realise an apparatus for pushing packaging containers which displays a simple and operationally reliable construction. This object has been attained by an apparatus for pushing a number of packaging containers carried in cassettes in motion in a first direction in a packaging machine, the apparatus comprising carriers by means of which the packaging containers may be pushed from a first position to a second position in relation to said cassettes. The present invention is characterised in that the apparatus comprises at least one belt which, in a first portion of the apparatus, moves in a second direction, and in a second portion of the apparatus moves in a third direction, that, between the first and second portions, there is provided a bending roller, that the second and third directions each make an angle with the first direction, that the carrier is connected to a shaft which is secured to the belt by means of a clamping device, and that the centre point of the shaft is offset a distance from the pitch line of the belt in a direction substantially at right angles thereto inwards towards the bending roller so that a mutual distance between two shafts measured in the first direction is substantially equal regardless of whether both of the shafts are located in the first or second portion or if the shafts are located on either side of the bending roller. By offsetting the centre point of the shaft a distance from the pitch line, it will be possible to realise synchronous driving also in the employment of belt operation for an apparatus for pushing packaging containers. A construction involving cam surfaces and linear guiding can thus be avoided. This affords numerous advantages, for example an apparatus may be realised which comprises few parts, this being advantageous both from the point of view of cleaning and wear. Similarly, there will be realised an apparatus which is light in weight. The apparatus also enjoys the advantage that it may readily be moved in the vertical direction if the volume of the packaging container is changed, i.e. it can be raised or lowered in relation to the packaging container conveyor. If the bottom configuration of the packaging container were also to be changed, only the carriers need to be replaced. This affords a highly flexible and economically viable solution. By securing the carriers on shafts which are then interconnected with the belt by means of a clamping device, the advantage will be afforded that the carriers may readily be replaced without the belt needing to be dismounted or changed. The time involved for service and maintenance work etc. may thus be reduced and, since the number of parts needing to be replaced is also fewer, the apparatus will be an economically viable solution also from this point of view.

In one preferred embodiment of the apparatus, the length of the distance from the belt pitch line is calculated according to the formula $$J = \frac{K}{\sin a}$$

where $\alpha$ is said angle and K is calculated in accordance with the formula $$K=R(\tan \alpha-\alpha)$$

where R is the radius from the centre of the bending roller to the pitch line and where $\alpha$ is given in radians. K is a distance in the first direction which must be compensated for in order that the mutual distance between two shafts will be the same regardless of whether both shafts are located in the first or second portion or whether the shafts are located one on either side of the bending roller.

In a further preferred embodiment, the carrier is provided with a surface adapted for abutment against the packaging container and is journalled on the shaft in such a manner that the surface of the carrier may rotate through at least said angle $\alpha$ in relation to the shaft. The carrier then adjusts itself in response to the packaging container, i.e. on contact with the packaging container, the surface of the carrier adjusts itself substantially parallel with the first direction so that a uniform force is applied on the packaging container.

Preferably, the apparatus comprises a first and a second pulley placed on the same height in relation to one another and placed one on either side of the bending roller. This affords an extremely simple construction, with few and durable parts which are easy to maintain and clean. For example, the apparatus withstands the daily cleaning process which is normally carried out in a packaging machine.

In one preferred embodiment, the belt is a toothed belt. By such means, conventional belts may be employed and it will shortly be shown that the securement of the shafts is facilitated by the teeth of the toothed belt.

In one preferred embodiment, the clamping device for fixing the shaft to the belt comprises a first part adapted for whole or partial abutment in a tooth gap of the belt and in support means in the shaft, the support means forming continuations of the tooth gap at each end thereof and in which support means the first part may be snapped down, and that the first part at each end is connected to a second part in the form of a yoke element, the yoke element being adapted to surround the shaft so that there is formed a wrapping angle between the abutment points of the first part in the support means in the shaft and the abutment points of the yoke element against the shaft which is sufficiently large in order that the geometry of the shaft will be able to retain the clamping device in a secured position. By means of a clamping device of this type, the carriers may very simply be secured on the belt and if one or more carriers need to be replaced, only this or these need be removed from the belt. The clamping device per se is simple and economical to manufacture.

Preferably, the shaft is provided with at least one depression which is adapted to at least partly accommodate the belt and in which depression the support means are placed. By providing the shaft with a depression for the belt, it will be very simple to position the centre point of the shaft a distance from the pitch line of the belt.

Preferably, the flat surface of the toothed belt is adapted to abut against a corresponding surface in the depression in the shaft. By such means, there will be obtained a stable and easily assembled construction.

In one preferred embodiment, each yoke element has an outer end which is adapted to be snapped each into a corresponding hole in the shaft. The hole minimizes the risk that the clamping device comes loose from its position locked to the belt and the shaft. Further, a small wrapping angle may be selected.

BRIEF DESCRIPTION OF THE ACCOMPANYING DRAWINGS

Figure 2:
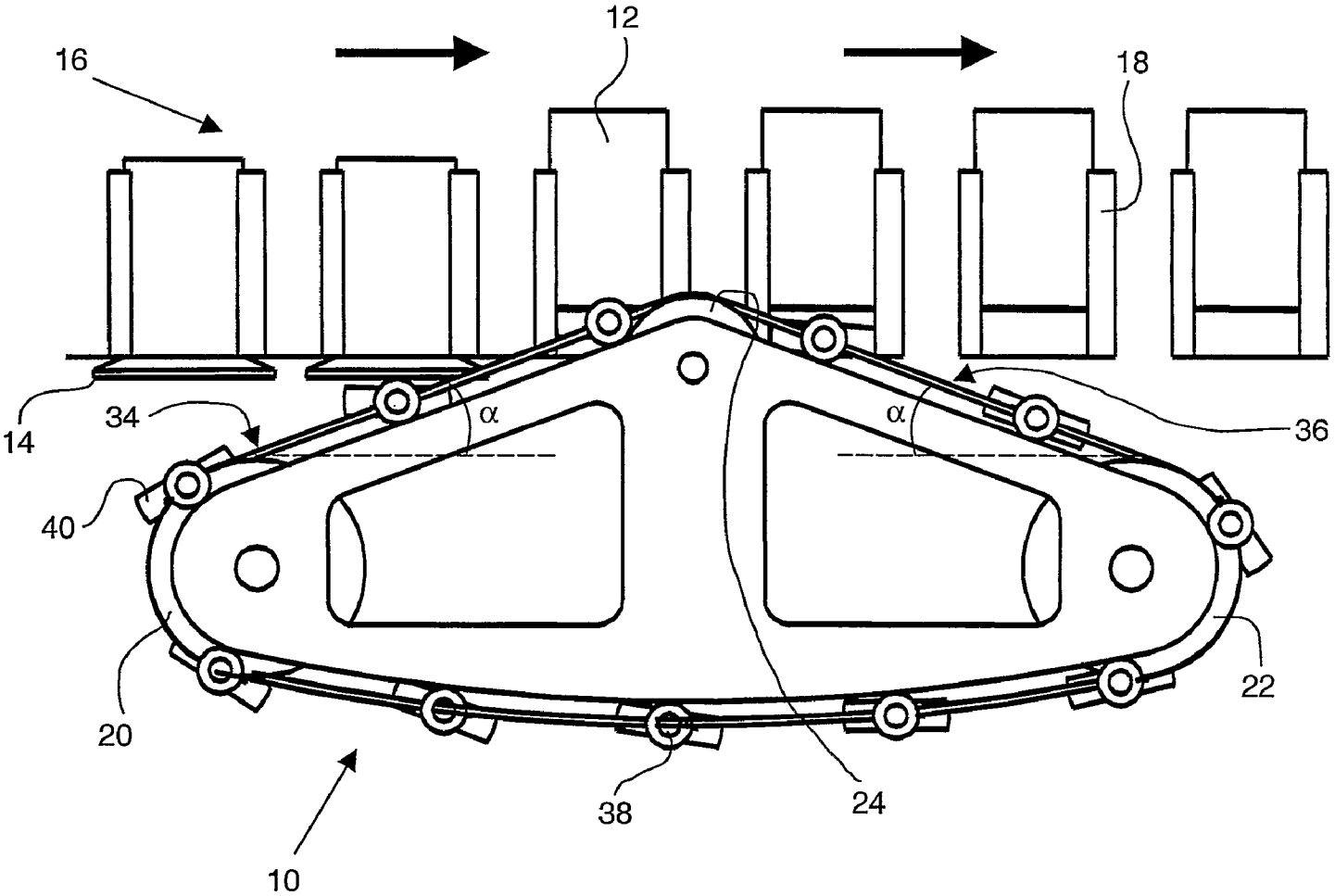
Figure 4:
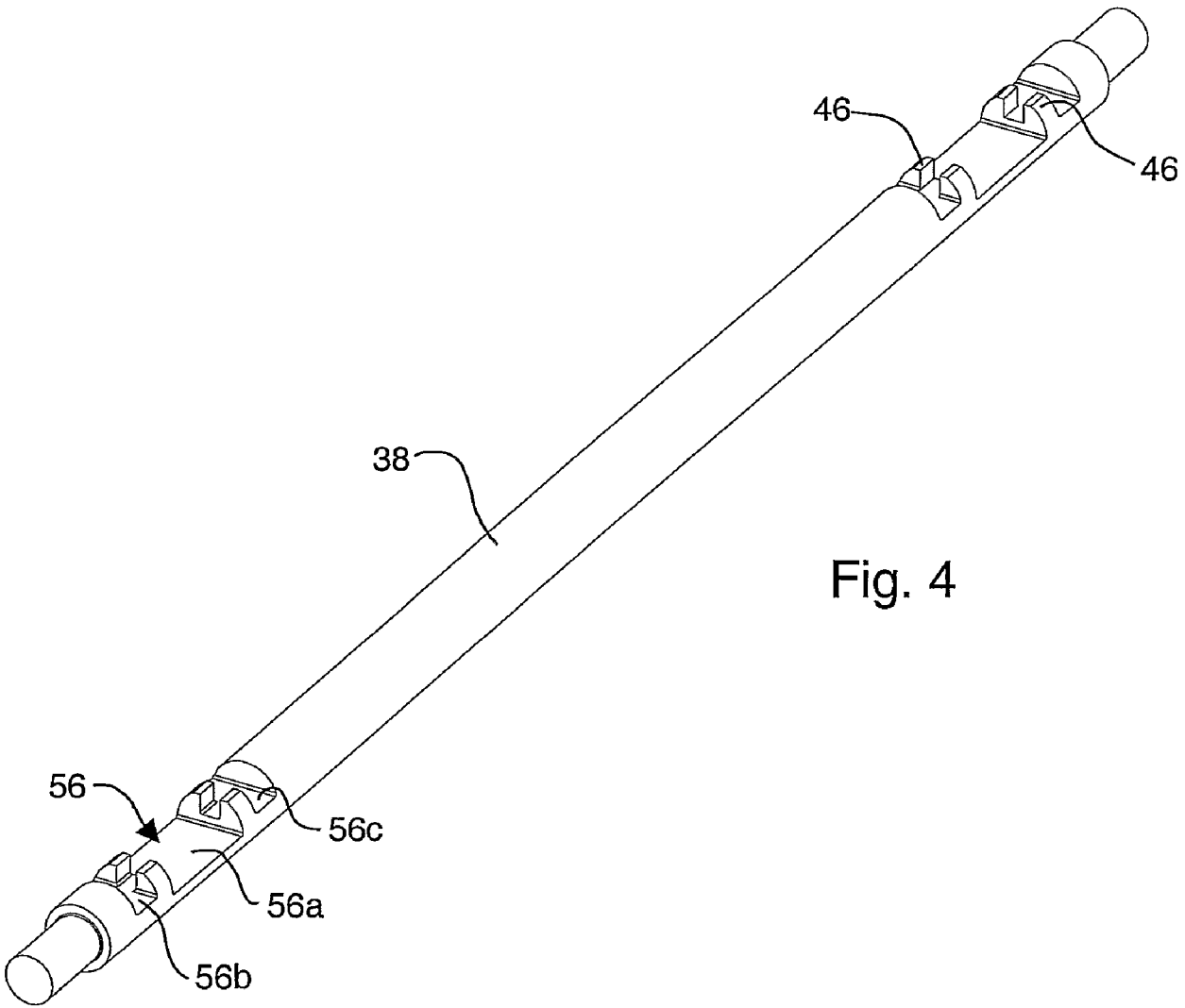
Figure 6:
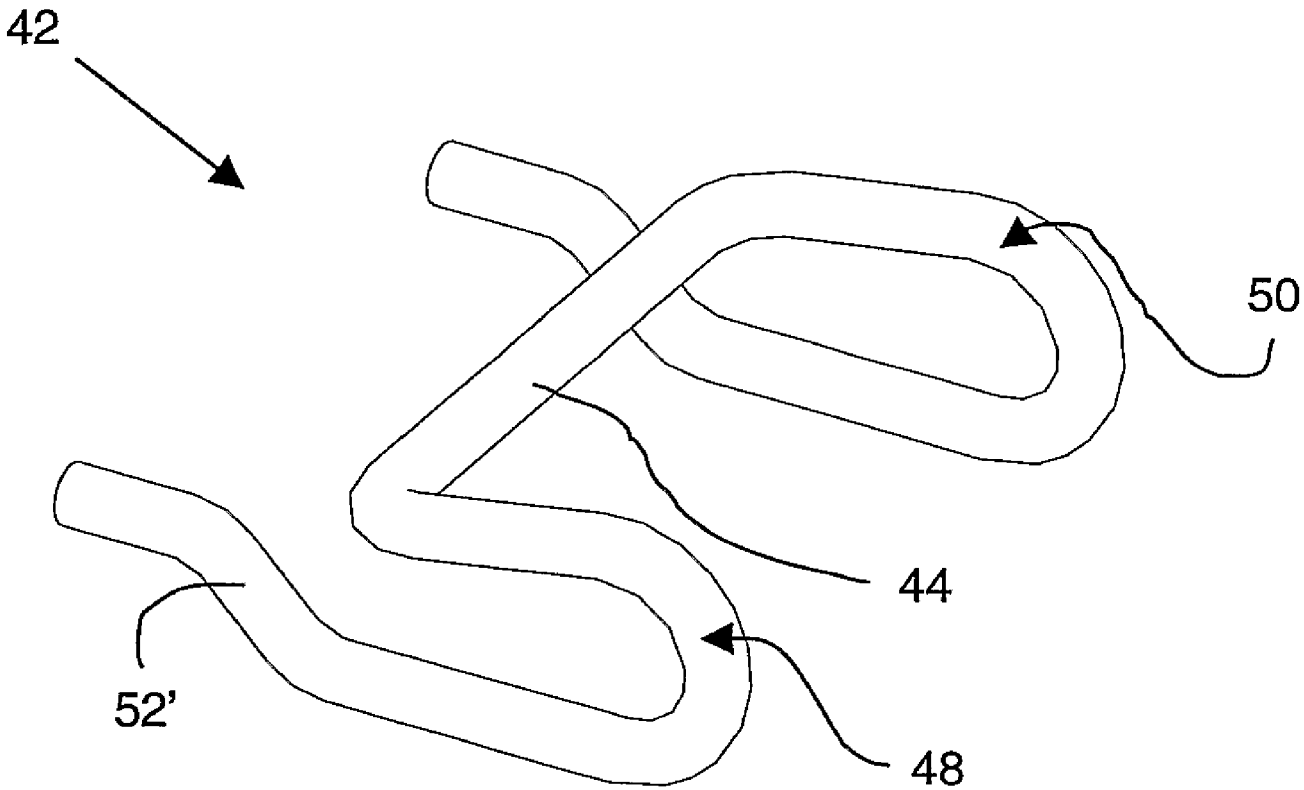
Figure 7:
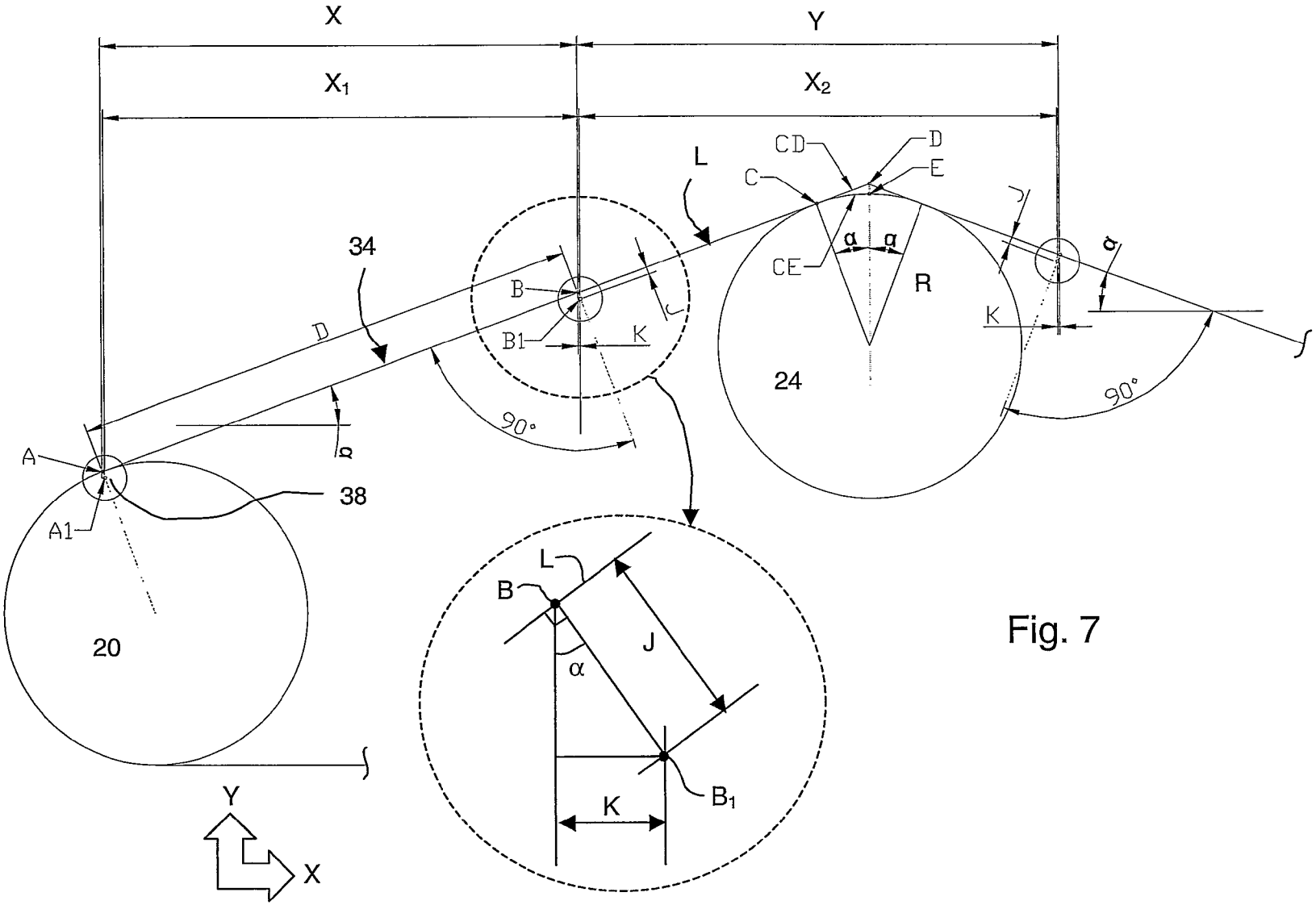

One currently preferred embodiment of the present invention will now be described in greater detail hereinbelow, with reference to the accompanying Drawings. In the accompanying Drawings:

FIG. 1 schematically shows in perspective view one embodiment of the apparatus according to the invention and a conveyor cooperating therewith;

FIG. 2 schematically shows a plan view of the view illustrated in FIG. 1;

FIG. 3 schematically shows, in a number of views, a first embodiment of a clamping device and how it secures a shaft to the belt;

FIG. 4 schematically shows a view in perspective of a shaft;

FIG. 5 schematically shows views I-V of different shaft cross sections and wrapping angles;

FIG. 6 schematically shows a view in perspective of a second embodiment of the clamping device; and FIG. 7 schematically illustrates the securement of the shafts.

DETAILED DESCRIPTION OF ONE PREFERRED EMBODIMENT

FIGS. 1 and 2 show one preferred embodiment of an apparatus, generically designated by reference numeral 10, for pushing moveable packaging containers 12 before a production step in a packaging machine for packing products, for example foods. In the example, the packaging containers are parallelepipedic packages produced from a laminated packaging material comprising a core layer of, for example, paper or paperboard and outer, liquid-tight layers of plastic.

The apparatus 10 in the present invention is located between a transverse sealing station (not shown) and a subsequent filling station (not shown) where the packaging containers are to be filled with their intended contents. When the packaging containers 12 pass the apparatus 10, they are completely open at the bottom. However, the top of the packaging container is sealed, but no final folding has yet taken place, for which reason the double-walled corner flaps 14 have not yet been folded in towards and sealed against the outside of the packaging container, but in this position point substantially straight out from the sides of the packaging container. The packaging containers are moved from the transverse sealing station to the filling station by means of a conveyor 16 and the direction of movement, from left to right in both figures, is marked by arrows and is designated the first direction. The conveyor 16 comprises cassettes 18 of the type described in EP 1062160 and each packaging container 12 is supported by a cassette 18. The cassette 18 as such will not be described in greater detail here, but reference is hereby made to the above mentioned EP document. To the left in the figures, the packaging containers 12 are placed with the open bottom upwards, and the transverse sealing fin which has been formed in the top of the packaging container 12 in the preceding station is thus turned to face downwards with the longitudinal direction of the fin substantially parallel with the direction of movement. The cassette 18 is open in the bottom and top and the sealing fin in the top of the packaging container 12 is located below the cassette 18. The task of the apparatus is, when the packaging container 12 passes, to push the packaging container 12 upwards in the cassette 18 so that the area of the packaging container 12 which is later to be sealed and form its bottom will project up out of the cassette 18, i.e. project a distance out from the upwardly open end of the cassette 18. The positioning in the vertical direction takes place in that the corner flaps 14 of the packaging container 12 are utilised and caused to cooperate with support means in the cassette 18.

The apparatus 10 comprises a first and a second pulley 20, 22 arranged at the same height in the vertical direction in relation to one another. Substantially centrally between the pulleys 20, 22, there is disposed a bending roller 24, the bending roller 24 being located a distance from the pulleys 20, 22 in the vertical direction, i.e. in the vertical direction upwards in the figures. An angle α is formed between the bending roller 24 and the first pulley 20 and an angle of the same size, also designated α, is formed between the bending roller 24 and the second pulley 22.

The pulleys 20, 22 and the bending roller 24 are journalled between a first and a second frame 26, 28, and at least the one pulley 22 is driven by drive means (not shown). In the example, the first pulley 20 consists of a first and a second pulley part 20*a*, 20*b* which are non-rotationally interconnected with one another by means of a shaft. Correspondingly, the second pulley 22 consists of a first and a second pulley part 22*a*, 22*b* which are non-rotationally interconnected with one another by means of a shaft. Similarly, the bending roller 24 consists of a first roller part 24*a* and a second roller part 24*b* which are non-rotationally interconnected with one another. A first drive belt 30 runs over the first pulley part 20*a* in the first pulley 20, the first roller part 24*a* in the bending roller 24 and the first pulley part 22*a* in the second pulley 22. A second drive belt 32 runs over the second pulley part 20*b* in the first pulley 20, the second roller part 24*b* in the bending roller 24 and the second pulley part 22*b* in the second pulley 22. In the example, these belts 30, 32 are conventional belts of the toothed belt type. The belts 30, 32 are driven synchronously clockwise in the figures. Along a first portion 34 from the first pulley 20 to the bending roller 24, the belts 30, 32 run in a second direction, this second direction making the angle α with the first direction, i.e. the direction of movement of the conveyor 16. In a second portion 36 from the bending roller 24 to the second pulley 22, the belts 30, 32 are driven in a third direction, this third direction also making the angle α with the first direction.

Shafts 38 are fixedly disposed to the belts 30, 32 substantially at right angles to the direction of movement. The securement of these shafts 38 to the belts 30, 32 will be described below. On each shaft 38, there is secured a carrier 40. The carrier 40 is designed as a plate and is journalled in one end of the shaft 38 which extends outside the pulley drive. The journaling is formed so that the plate 40 constitutes a rocker which may pivot about the shaft 38 so much that the top surface of the plate may be substantially parallel with the first direction even though the shaft 38 to which it is secured is located, for example, in the first portion 34, in other words moves in the second direction. Thus, the plate 40 is capable of pivoting through at least the angle α in relation to the shaft 38. When the plate 40 comes into abutment against the packaging container 12 and force is applied, it adjusts itself and an equilibrium of force is obtained.

The conveyor 16 and the belts 30, 32 in the apparatus are driven synchronously with each other.

Each carrier 40 is, as was mentioned previously, secured on a shaft 38 and this shaft is secured to both of the belts 30, 32 by means of a clamping device 42 at each belt 30, 32. In the following disclosure, and with reference to FIG. 3, a first embodiment of this clamping device 42 will be described in greater detail and it will be shown how the shaft 38 can, by means of the clamping device 42, be secured to, for example, the first belt 30. The clamping device 42 comprises a first part 44 in the form of a pin adapted to be able to abut against the belt 30. The abutment against the belt 30 takes place in a tooth gap in the belt 30. The pin 44 is also adapted to be able to be snapped down as well in support means 46 which are formed in the shaft 38. These support means 46 form continuations of the tooth gap at each end thereof, i.e. the support means 46 are formed as small "tooth gaps" which are in alignment with the tooth gap in the belt 30. The pin 44 may be snapped down in the support means 46. On either side of the first part 44, i.e. at each end of the pin, there is disposed a second part 48, 50, respectively. The first part 44 is thus a central part. The two other parts 48, 50 are substantially identical and each have the form of a yoke element which is adapted to be able to surround the shaft 38. Each yoke element has an outer end 52, i.e. a free end, which is adapted to be snapped into a corresponding hole 54 in the shaft 38. In order that the shaft 38 be able to be placed such that its centre point is located a distance from the pitch line, which will later be described, the shaft 38 is provided with a depression 56 disposed to at least partly accommodate the belt 30. The depression 56 is formed as a recess and has a surface which is adapted to abut against the flat surface of the belt. The surface has an extent in the longitudinal direction of the shaft which is larger than the belt 30 seen in the width direction of the belt so that the surface may also be able to accommodate the two yoke elements 48, 50. The support means 46 are formed in discontinuations in the surface, i.e. the depression 56 in the shaft 38 actually consists of three portions, a central portion 56*a* which can accommodate the belt 30, as well as two minor outer portions 56*b*, 56*c* outside the support means 46 which can each accommodate one of the yoke elements 48, 50, see FIG. 4. The outer portions 56*b* and 56*c* are intended to support the yoke elements and take up a part of the spring force so that the clamping device does not press down with all of its force against the belt. By such means, the risk that the pin 44 "eats" its way through the belt is minimized. It is thus the outer ends of the pin 44 adjacent the yoke elements 48, 50 that are snapped down in the support means 46. The support means 46 are designed so that they permit rotation of the pin 44 so that the yoke elements 48, 50 can surround the shaft 38. It should be perceived that the term "surround" does not necessarily signify that the yoke elements 48, 50 totally abut against the shaft 38, it is sufficient that there is a point of abutment somewhere along the yoke form in addition to the point of abutment between the pin 44 and the support means 46.

The yoke elements 48, 50 are adapted to surround the shaft 38 so that there is formed a wrapping angle β between the abutment points of the first part in the support means 46 in the shaft 38 and the points of abutment of the yoke elements against the shaft 38 which is sufficiently large for the geometry of the shaft to be able to retain the clamping device 42 in a secured position, i.e. in a position where the clamping device 42 holds the belt 30 locked against the shaft 38. FIG. 5 illustrates that which is meant by a sufficiently large wrapping angle β. In view I can be seen a cross section of a shaft 38 with hole 54 similar to that described above. Thanks to the hole 54, the abutment points of the yoke elements can, in this case, have a wrapping angle β which is slightly less than 180°. FIG. 6 shows a second embodiment of the clamping device 42 where the yoke elements 48, 50 are not intended to be snapped into holes in the shaft 38, but where the outer parts 52' of the yoke elements 48, 50 are disposed merely to abut against the shaft 38. This variation requires a wrapping angle β of at least 180°, see view 11 in FIG. 6. The shaft 38 may also be designed with a triangular cross section, as in view III, or with a cross section in the form of a polygon, for example a square, as shown in view IV, and then it is sufficient that the wrapping angle β sweeps past the first corner. It should, however, be perceived that the configuration and cross sectional area of the yoke element are naturally of importance for that wrapping angle β which is required. If the yoke element 48, 50 is weak, for example in that it has a slight cross sectional area and large yoke form, a larger wrapping angle β is probably required, see view V.

In the described first embodiment of the clamping device 42 which is shown in FIG. 3, the hole 54 in the shaft 38 is placed substantially in register with the depression 56, i.e. on the other "side" of the shaft 38. Thus, the wrapping angle β is here substantially 180°.

The clamping device 42 may be simply manufactured by bending of a steel bar.

On mounting of the clamping device 42, the toothed belt 30 is first placed so that its flat surface comes into abutment against the flat surface in the depression 56 of the shaft 38, see FIG. 3. Thereafter, the first part 44, the pin, of the clamping device 42 is pressed down in the support means 46, see the upper right-hand view in FIG. 3. Thereafter, the yoke elements 48, 50 are rotated so as to surround the shaft 38, see the upper left-hand view in FIG. 3, so that the outer ends 52 of the yoke elements 48, 50 snap into the holes 54 on the underside of the shaft 38, see corresponding lower views in FIG. 3.

In the following disclosures, the securement of the shafts 38 will be described with reference to FIG. 7. Since both of the belts 30, 32 are driven synchronously and are substantially identical both in configuration and positioning, the securement will only be described with reference to the first belt 30 for the sake of simplicity. The mutual distance between two shafts 38 is designated D and this distance may be maintained as long as the centre points of the two shafts 38 are located on a line L between the geometric points A and D in the figure and bend over a bending roller 24 with an infinitely small radius. In most cases however, the bending roller 24 has a radius which is not negligible. In the example, the radius is designated R and is measured from the centre of the bending roller to the pitch line. If the centre points of the shafts 38 were placed on the pitch line of the belt 30, see line L in the figure, i.e. on that line where the stretching is zero, the shafts 38 would take a "short cut" over the point E instead of over the point D, since the inclination of the belt over the bending roller 24 will deviate from the angle α. Thus, a mutual distance Y in the x axis between two shafts 38 which are placed on either side of the bending roller 24 would be longer than a distance X in the x-axis between two shafts 38 which are both located on the same side of the bending roller 24, for example in the first portion 34 of the apparatus 10 which is shown in the figure.

In order that the shafts 38 move at substantially the same speed all of the time, i.e. in order that the shafts 38 do not lose their mutual spacing X in the x-axis when they move over the bending roller, i.e. change direction of movement, the shafts 38 are secured to the belt 30 so that the centre point of each shaft 38 is displaced a distance J from the pitch line L of the belt. The distance J is measured in a direction inwards towards the bending roller 24, this distance being substantially at right angles to the tangent in each point of the pitch line L. In the first portion 34, between point A and C, the distanceJ is thus substantially at right angles to the second direction, and in the second portion 36, the distance is substantially at right angles to the third direction. The distance J may be calculated in accordance with the following reasoning.

By calculating the length difference K between the length CD, i.e. the distance between the points C and D, and the length CE, i.e. the arc segment between points C and E, it is possible to be able to compensate for the "short cut" so that Y is maintained substantially as long as X. The length difference K is a distance in the x-axis and is employed for calculating J in accordance with the formula $$J = \frac{K}{\sin a}$$

where K is, as was mentioned previously, the length difference CD minus CE, where $$CD = R\tan a \text{ och } CE = 2\pi R\frac{a}{360}$$

K can thus be simplified in accordance with the following $$K = R(\tan\alpha - \alpha)$$

where α is indicated in radians.

By moving the centre point of the shaft 38 the distance J from the pitch line L in a direction inwards towards the bending roller 24, the mutual distance $X_2$ in the x-axis between the two shafts 38 which are placed on each side of the bending roller 24 can be substantially as long as the mutual distance $X_1$ in the x-axis between the two shafts 38 which are both located on the same side of the bending roller 24. This understanding is facilitated if points B and $B_1$ are considered. Point B lies on the pitch line L and point $B_1$ is the centre point of a shaft 38 which is moved the distance J from the pitch line L. When the point B reaches the tangent point C and the belt 30 begins to deviate from the angle α, the point $B_1$ will be located the distance K further ahead. When point B reaches point E and the angle is zero, point $B_1$ is located exactly beneath point B and thereby the length difference K is compensated for. The corresponding applies for point A and $A_1$. For points which are located on the other side of point E in a direction towards the second pulley (not shown) the converse circumstance applies, i.e. when point B has passed the bending roller 24, point $B_1$ will be located behind point B, i.e. point $B_1$ will be located more proximal the bending roller than point B seen in the x-axis. Thus, $X_1$ and $X_2$ will be substantially of equal length.

Even though the present invention has only been described with reference to one currently preferred embodiment, it should be obvious to the skilled reader that the present invention is not restricted thereto, but that a plurality of variations and modifications are conceivable without departing from the scope of the appended Claims.

In the example, the apparatus has been shown with two belts 30, 32, but this number may naturally be modified.

Similarly, it should be obvious to the skilled reader that the apparatus may be designed with flat belts or chains instead of toothed belts.

What is claimed is:

1. An apparatus for pushing a number of packaging containers which are supported in cassettes in movement in a first direction in a packaging machine, said apparatus comprising: carriers which push the packaging containers from a first position to a second position in relation to said cassettes; at least one belt which, in a first portion of the apparatus, moves in a second direction and in a second portion of the apparatus moves in a third direction; a bending roller disposed between the first and the second portions; the second and third directions each making an angle α with the first direction; the carrier being connected to a shaft which is secured to the belt by a clamping device; and a centre point of the shaft being offset a distance from the pitch line of the belt in a direction substantially at right angles thereto inwards towards the bending roller so that a mutual distance between two shafts, measured in the first direction, is substantially of equal size regardless of whether both shafts are located in the first or second portion or whether the shafts are located one on either side of the bending roller.

2. The apparatus as claimed in claim 1, wherein the length of the distance from the belt pitch line is calculated in accordance with the formula $$J = \frac{K}{\sin\alpha}$$

where α is said angle and K is calculated in accordance with the formula $$K = R(\tan\alpha - \alpha)$$

where R is the radius from the centre of the bending roller to the pitch line and where α is disclosed in radians.

3. The apparatus as claimed in claim 1, wherein the carrier is provided with a surface adapted for abutment against the packaging container and is journalled on the shaft in such a manner that the surface of the carrier may rotate at least through said angle α in relation to the shaft.

4. The apparatus as claimed in claim 1, further comprising a first and a second pulley placed on the same height in relation to one another and placed on either side of the bending roller.

5. The apparatus as claimed in claim 1, wherein the belt is a toothed belt.

6. The apparatus as claimed in claim 5, wherein the clamping device for securing the shaft to the belt comprises a first part adapted for whole or partial abutment in a tooth gap in the belt and in support means in the shaft, said support means forming continuations of the tooth gap at each end thereof and in which support means the first part may be snapped down; and wherein the first part at each end is connected to a second part in the form of a yoke element, the yoke elements being adapted to surround the shaft so that there is formed a wrapping angle between the points of abutment of the first part in the support means in the shaft and the points of abutment of the yoke elements against the shaft which is sufficiently large for the geometry of the shaft to be able to retain the clamping device in a secured position.

7. The apparatus as claimed in claim 6, wherein the shaft is provided with at least one depression adapted to at least partly accommodate the belt and in which depression the support means are placed.

8. The apparatus as claimed in claim 7, wherein the flat surface of the toothed belt is adapted to abut against a corresponding surface in the depression in the shaft.

9. The apparatus as claimed in claim 5, wherein each yoke element has an outer end which is adapted to be snapped each into a corresponding hole in the shaft.

* * * * *